US005614137A

United States Patent [19]

Pandit et al.

[11] Patent Number: 5,614,137

[45] Date of Patent: Mar. 25, 1997

[54] TEMPERATURE CONTROL IN EXTRUDERS

[75] Inventors: Madhukar Pandit, Kaiserslautern; Karl-Heinz Buchheit, Ramstein, both of Germany

[73] Assignee: Mannesmann AG, Germany

[21] Appl. No.: 218,829

[22] Filed: Mar. 28, 1994

[51] Int. Cl.[6] ..... B29C 47/92

[52] U.S. Cl. ..... 264/40.6; 264/40.7; 425/144

[58] Field of Search ..... 72/8, 13, 14, 253.1; 264/40.6, 40.7; 425/143, 144

[56] References Cited

U.S. PATENT DOCUMENTS

| | | | |
|---|---|---|---|
| 2,863,557 | 12/1958 | Munker | 72/9 |
| 3,422,648 | 1/1969 | Lemelson | 72/8 |
| 3,670,542 | 6/1972 | Kemppinen et al. | 72/8 |
| 4,675,826 | 6/1987 | Gentry et al. | 72/13 |
| 5,237,844 | 8/1993 | Duri | 72/13 |
| 5,306,365 | 4/1994 | Reighard | 72/13 |

*Primary Examiner*—Mathieu D. Vargot
*Attorney, Agent, or Firm*—Bachman & LaPointe, P.C.

[57] ABSTRACT

A process for the cyclic control of extruders which facilitates the precise control of an extruder to achieve maximum output and at the same time optimal quality of the extruded profiles. Accordingly therefore the extrusion velocity is controlled in such a way that the profile exit temperature is constant and equal to a prescribed temperature trajectory. Thereby the extrusion velocity and the profile exit temperature are measured over the complete cycle interval for each and every cycle k, and with the knowledge of the relationship between these quantities and the trajectory of the extrusion velocity of the cycle k, the trajectory of the extrusion velocity for the (k+1)th cycle is determined, such that the control error and the control effort are as low as possible and after completion of the (k+1)th extrusion cycle the whole process is repeated for every subsequent cycle therefore until the whole extrusion program is completed. The process is especially suited for the manufacture of extruded profiles of metals with low and/or wavelength dependent emmissivity and/or variable surface characteristics, in particular for the manufacture of extruded aluminium and aluminium alloy profiles.

12 Claims, 1 Drawing Sheet

FIG. 1
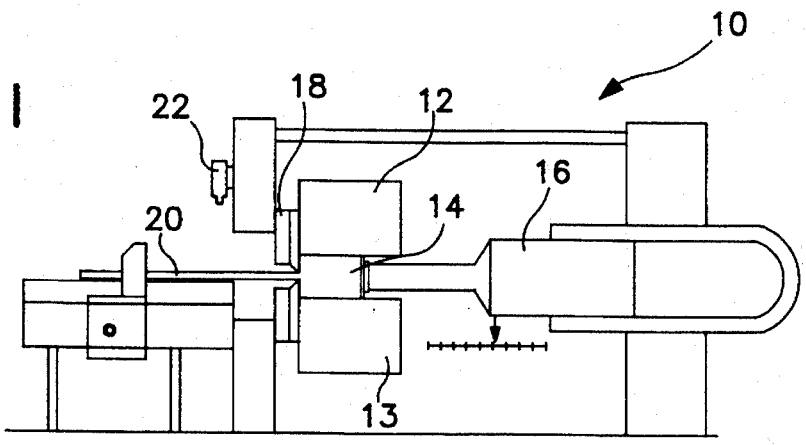
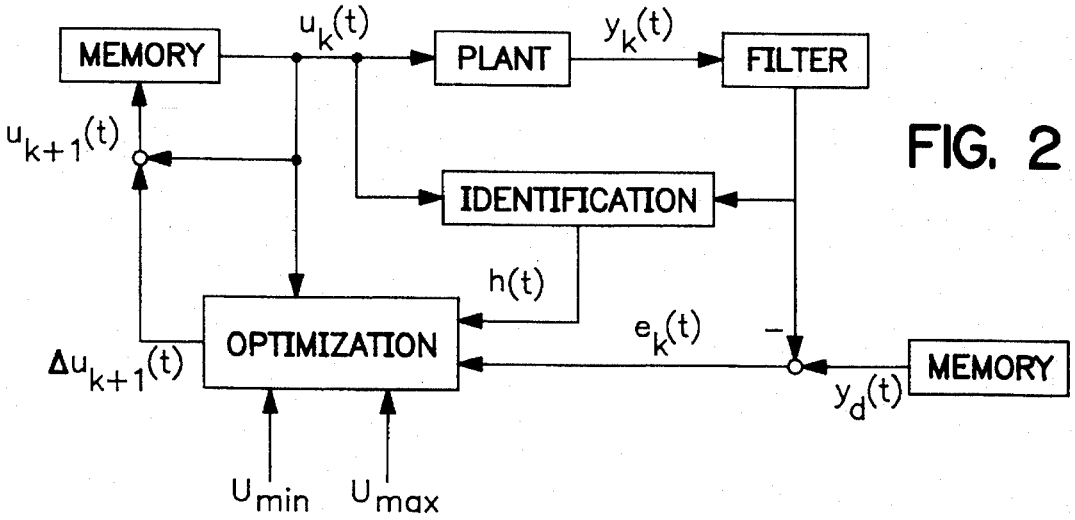
FIG. 2
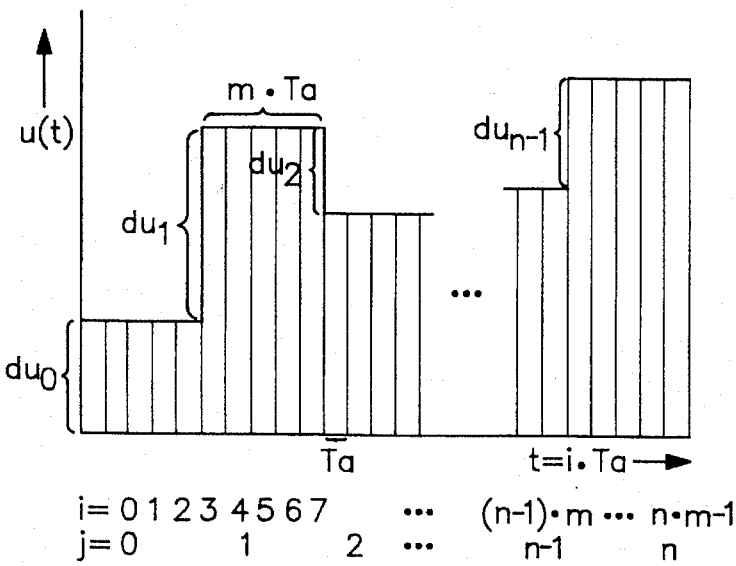
FIG. 3

TEMPERATURE CONTROL IN EXTRUDERS

BACKGROUND OF THE INVENTION

The invention pertains to a process for the control of an extruder and the application of the process for the production of extruded section bars.

Extrusion is a well-known process which is applicable in many cases for the manufacture of section bars by extruding materials like for e.g. metal, glass or plastics through a die, whereby the die can possess an opening with almost any cross section from circular to complicated patterns and can have one or more orifices.

Referring to FIG. 1, extruder 10, as known in the art consists essentially of a receptacle 12 with a cylindrical bore 13 of any cross section which accomodates the material to be pressed, usually in the form of a cylindrical billet 14, and a ram provided with a press-disc, whereby a 18 die is provided at one end of the cylindrical bore 13 of the receptacle 12.

In the manufacture of extruded section bars 20, the metal to be extruded is loaded into the cylindrical bore of the receptacle and by applying a high axial pressure via the pressure disc is pressed through the die, so that the material takes on a plastic state under the given temperature and can be extruded, as profile or bar 20, through the opening in the die 18.

In the extrusion of crystalline or vitreous material, the cross section of the section bar corresponds to the cross section of the die opening. However, this does not hold for the extrusion of polymers with structure-viscous (decrease in the viscosity with increase of mechanical stress), entropy-elastic (expansion of the section) and visco-elastic (time dependant coupling of viscosity and elasticity) properties.

The plastic deformabilty of the material to be extruded, and with that the amount of material extruded per unit time, depends upon—apart from the composition of the extruded material and the pressure applied—mainly on the process temperature. To attain the highest extruder speed possible in this thermal conversion process, the exit temperature is kept as high as possible. The maximum possible exit temperature lies on the one hand below the melting point of the extruded material and on the other hand is determined by the condition, that the section bar coming out of the die should not be deformed in the hot state. Furthermore, the bar exit temperature has considerable influence on the material properties of extruded section bars and consequently on the product quality (homogenity, mechanical stresses etc.). Consequently, also due to reasons of quality control, there is considerable interest to prescribe and maintain a definite constant section bar exit temperature in the process. Such a process with a predefined exit temperature which is made to be constant is termed as isothermal extrusion.

The balance of the energy components is obtained from the difference between all the energy inputs (mechanical work and heat) and the outgoing energy (plastic shaping, heat conduction). Here the essential energy components for the heat shaping process refers to the part of the extruded material block which changes its plastic dimensions. The resulting temperature of the section bars when leaving the die can be specifically influenced through the pre-heating temperature of the billets and the extrusion speed.

The practical implementation of isothermal extrusion requires complete knowledge and mastery of all process parameters and in particular all thermal process variables, which is the reason why this process contains many problems for which no technologically satisfactory solutions have been found. Such problems are generally attacked by using known control system methods such as simulated or controlled isothermal extrusion.

In simulated extrusion the exit temperature is calculated in advance through a simulation model, whereby the extrusion speed is the relevant process parameter for control purposes. The extrusion process is however a complicated thermo-mechanical system with many parameters which are not easily incorporated in the model, so that the analytical description of the whole extrusion process is incomplete and the description with numerical methods is imprecise. This is the reason why this method is not suitable for control of extrusion.

In the case of controlled extrusion, the establishment and maintenance of the desired extrusion exit temperature considered as the control variable is obtained through a closed loop control which calculates the necessary extrusion speed correction by constant comparison of the desired and actual values of the control variable. A radiation pyrometer 22, as shown in FIG. 1, is usually used for the measurement of the extrusion exit temperature.

The pyrometric temperature measurement is performed by exploiting Planck's radiation loss which however holds only for ideal black bodies. If the total energy of the emitted radiation is known, then the temperature can be calculated from the measurement of the energy in a certain spectral region by using Planck's radiation law, whereby the temperature represents the temperature which the body would have if it were a black body. As most of the objects are not ideally black, the true temperature is higher than the one calculated in this way. In order to calculate the temperature of a real object, the emissivity, that is the radiation capability of the considered body, should be known. The emissivity of an opaque body is defined as the quotient of the energy emitted by the body and the energy emitted by an ideally black body at the same temperature. The emissivity can be physically described by means of a multiplicative emissivity factor ($\epsilon$) which appears in Planck's radiation law. An ideal black body has the emissivity degree $\epsilon$ equal to 1.

The contactless pyrometric temperature measurement leads however, in the case of materials with small and/or wavelength-dependent emissivity ($\epsilon<0.1$) and/or variable surface characteristics, as for example material consisting of aluminium or aluminium alloys, often to a wrong temperature measurement. Therefore, controlled extrusion is not implementable for such materials. In the DE-OS 34 04 054 a production line for isothermal extrusion is described in which an open loop control gives always the same extrusion speed curve v(t) equivalent to the equation $$v(t)=v_1+(v_0-v_1)\exp(-At)$$

for a batch of material, such that the extrusion corresponds to isothermal extrusion process inside a batch even without feedback of the measured temperature run. Thereby $v_0$ and $v_1$ denote the initial extrusion speed and the extrusion speed in the steady state of the extrusion process respectively and A a parameter which depends on the mechanical properties of the extruded material as for example the tensile limit which must be measured in the beginning of the batch. For the calculation of $v_0$ and $v_1$ a strongly simplified model of the extruder given by $$v(t)=v_1-(v_1-v_2)\exp(-Bt)$$

is used whereby v(t) is the time-dependent exit temperature of extruded material, $v_1$ the temperature of the ram in the stationary stage of the extrusion, $v_2$ the temperature of the billet and B a parameter which represents the mechanical properties of the billet.

A disadvantage of the open loop control described in DE-OS 34 04 054 is to be found in the rigid pre-defined structure of the input function which consists of an exponential part and a constant function part. Such a form of a curve is often not suitable to achieve constant exit temperature. Furthermore, changes in the thermal balance of the extruder as for example, changes in the receptacle temperature, the tool temperature or the billet temperature inside a batch are not taken into account in this process. The model defined by means of the relation of v(t) of the extruder consists of a constant term and an exponential term and thereby represents only very roughly the complicated thermal balance of the extruder.

SUMMARY OF THE INVENTION

The objective of the presented invention is to develop a process which can overcome the disadvantages described above and which permits the precise control of the extruder for attaining maximum productivity and at the same time optimal quality of the extruded bar.

For achieving the objectives and advantages set forth above, the present invention includes a process for controlling a cyclic extrusion process of an extrusion plant from cycle to cycle, wherein an extruder velocity input function $v_k(t)$ over a cycle is iteratively adjusted from cycle to cycle for making an extrudate exit temperature $va_k(t)$ output function substantially equal to a prescribed exit temperature output function $va_w(t)$. The process comprises measuring for every cycle (k) an extrusion velocity input function $v_k(t)$ representing said extrusion velocity as a function of time and said exit temperature output function $va_k(t)$ representing said exit temperature as a function of time; determining a plant operator which together with said measured extrudate exit temperature output function $va_k(t)$ and said extrusion velocity input function $v_k(t)$ define a plant equation for said cycle (k); invoking said plant equation for said cycle (k) for estimating an extrudate exit temperature output function $va_{k+1}(t)$ of a cycle (k+1) for any chosen extrusion velocity input function $v_{k+1}(t)$ by inputting into said plant equation said extrusion velocity input function $v_{k+1}(t)$ for said cycle (k+1), wherein said extrusion velocity reference input function $v_{k+1}(t)$ for said cycle (k+1) can be chosen arbitrarily; calculating via iteration an optimal value for said extrusion velocity reference input function $v_{k+1}(t)$ for said subsequent cycle (k+1) for substantially achieving a prescribed extrudate exit temperature output function $va_w(t)$ and suppressing abrupt changes of said optimal value for said extrusion velocity input function $v_{k+1}(t)$ by minimizing a prescribed performance index which takes into account not only an estimated control error but also the abruptness of changes in said optimal value for said extrusion velocity input function $v_{k+1}(t)$, said estimated control error defined by a deviation between said prescribed extrudate exit temperature output function $va_w(t)$ and said extrudate exit temperature function $va_{k+1}(t)$ estimated and obtained in said step of invoking; considering a prescribed boundedness of said extrusion velocity input function $v_{k+1}(t)$ of said cycle (k+1) while performing said step of calculating; and repeating the steps of measuring, determining, invoking, calculating and considering for each subsequent cycle.

BRIEF DESCRIPTION OF THE DRAWINGS

FIG. 1 is a schematic diagram of the central components of an extruder which may be used with the principals of the present invention;

FIG. 2 is a schematic diagram representing a cyclic control system; and

FIG. 3 is a graph indicating the extrusion speed of an extruder in a cycle (k).

DETAILED DESCRIPTION OF THE PREFERRED EMBODIMENT

In the invention this is achieved by controlling the extruding speed v(t) of the extruder in such a way that the bar exit temperature va(t) is as constant as possible and equal to a prescribed run of $va_w(t)$ and a) the temperature control operates cyclically;

b) the temporal runs of the extrusion velocity $v_k(t)$ and the bar exit temperature $va_k(t)$ during every cycle k are measured;

c) the dependence of the bar exit temperature $va_K(t)$ on the extrusion speed $v_k(t)$ during the whole cycle k is determined;

d) the run of the extrusion velocity $v_{k+1}(t)$ for the next cycle k+1 is determined with the aid of this relationship and the temporal runs of $v_k(t)$ of the extrusion velocity $v_{k+1}(t)$ in such a way that the control error $$e_{k+1}(t)=va_w(t)-va_{k+1}(t) \quad (1)$$

and the control input $$dv_{k+1}(t)=v_{k+1}(t)-v_k(t) \quad (2)$$

are as small as possible, whereby the desired temperature run can be defined individually for every cycle;

e) limitations of the control input $v_{min,k} \leqq v_k(t) \leqq v_{max,k}$ are taken into account;

the extrusion speed $v_{k+1}(t)$ is calculated before beginning the extrusion cycle k+1;

g) the determined $V_{k+1}(t)$ is not changed during the cycle k+1;

h) after completion of the extrusion cycle k+1 the process steps b) to g) are repeated in a recursive way for every further extrusion cycle till the extrusion program has been completed.

With the process invented a process has been described which permits any possible form of the input function. In order to react to changes of the thermal balance, the input curve can be adjusted after every bar, that is after every cycle.

The correction of the input curve is performed in the invention on the basis of a linear model in the neighbourhood of the instantaneous operating point of the extruder. The parameters of the linearized model are determined after every bar.

Thus, the invented process is in a position to correct errors in the modelling by constantly correcting the input curve and also allows a corrective reaction to changes in the thermal balance of the extruder.

The adaptivity of the invented cyclic control, adjusts itself to the operating condition of an extruder and thus leads to a marked increase in the mean extrusion speed.

The invented process differs from well-known set-point controls in that it does not optimize only a local operating point but it optimizes the whole cycle. Because of the repetitive nature of the control process, the experience gained in cycle k is automatically used while generating the input curve k+1, thereby providing for a feedback from one cycle to the next. Consequently this control process is less prone to failures of the parametric measurement system, and is thus suitable for the temperature control of extruders for manufacture of extruded section bars with small and/or wavelength dependent emissivity ($\epsilon<0.1$) and/or of changing surface characteristics, and is thus especially useful for the manufacture of extruded section bars of aluminium and aluminium alloys.

In the extrusion of aluminium or its alloys the material to be extruded is heated to 400° to 500° C. in an oven and loaded subsequently into a receptacle. This is closed at the one end with a die with an opening or a break-through with the same cross section as required of the bar to be extruded. At the end opposite to the end of the die the material to be extruded is pressed with a ram by subjecting it ˆ to a high pressure of more than 10 MN (Mega Newton) till all the material excepting for a small residue is extruded through the die. After completion of this cycle a new billet is loaded into the receptacle and the extrusion process is repeated.

To illustrate the extrusion process, the essential components of such an extruder 10, as discussed above, and the thermal influences of the process are shown in FIG. 1.

Under control system aspects the following points are relevant for an extruder 10 with a radiation pyrometer 22 as the measuring instrument for the control variable:

- The desired curve of the exit temperature $va_k(t)$ of the extruded aluminium bar 20 is known before the cycle begins.
- The period of a cycle $T_{cyc}$ has always about the same value, whereby the cycle period varies between 60 and 1000 s depending on the extruder type, the die 18 and the alloy. By employing the same machine and the same die 18 and the same alloy, the system changes in a cycle can be limited to ±20%.
- The thermal system behaviour changes only slowly with time and is essentially determined by the receptacle 12, whose thermal time constants typically lie between 3 and 5 hours.
- The process is non-linear and can hardly be described by analytical means.
- The process behaviour is deterministic, i.e. relevant process parameters, such as for instance the receptacle 12, die 18 and billet 14 temperatures or the geometrical dimensions of the receptacle and the die do not change randomly; thus the process is not subject to stochastic parameter variations and is always reproducible.
- Every cycle has the same initial state.
- The input variable of the process (extrusion velocity) considered here and its rate of change are limited in magnitude.
- The measurement of the control variable (bar exit temperature va involves considerable errors, measurement disturbances and a large dead time (delayed reaction) thus making it expedient to process the data off-line. Whereas the on-line processing of the measurement signals is performed during the extrusion process, the evaluation and the processing is done off-line in the times between two extrusion cycles.

The structure of the invented process, as is clear from FIG. 2 which shows the principle of the functioning of a cyclic control system, makes it possible to generate and maintain a constant bar exit temperature $\theta a(t)$ corresponding to the desired temperature run $\theta a_w(t)$. The control hardware is thereby the influencing part of the control system and the control plant the part of the control system which is influenced. After completion of the extrusion cycle, the run of the control input is calculated from the run of the extrusion speed $v_k(t)$ and the exit temperature $\theta a_k(t)$. This is done by an identification, i.e. the calculation of the step response $h_k(t)$ of the plant for $0 \leqq t \leqq T_{zyk}$.

The term identification generally implies the calculation or the estimation of parameters of a given system model equation as for example the calculation of the coefficients of differential equations or the calculation of the support points of the step response as is suggested below. The optimizing process is consequently the step response $h_k(t)$ and the control error $e_k(t)$ a correction curve or a correction trajectory $dv_{k+1}(t)$ calculated and added on to the trajectory $v_k(t)$. The curve $v_{k+1}(t)$ thus determined is then stored in a register and is recalled by the execution of the next cycle.

The invented process also facilitates the suppression of measurement signals as in contrast, to known control concepts, powerful non-causal filters can be employed. Thereby the output $y(t_0)$ of a non-causal filter at a time instant to dependent not only—as in the case of causal filters—on the input values $x(t_0-\Delta t)$ with $\Delta t>0$, but also on the values of $x(t_0+\Delta t)$. In the invented process this leads to a control system which is robust and reliable with respect to measured values in spite of very difficult scenarios.

Because of the thermal inertia of the extruder, changes of system parameter, as for instance the tool, the receptacle, the billet or the ram temperature of consecutive cycles are negligibly small, so that the cyclic control can follow these changes fast enough and offer an optimal process run. Also, the identification of the control plant yields faster convergence so that already after a few cycles the process attains its steady state.

The measurement and processing of the measured values is generally performed with data processing equipment with limited computing capacity, as for instance with microcomputers. In order to reduce the computation capacity for the cyclic control scheme, the temporal functions of the exit temperature and the extrusion speed are sampled at discrete sampling instants.

One expedient way of implementing the invented process is such that a) the continuous time behaviour is subdivided into discrete time intervals $T_A$ $$t=iT_A,\ i=0,1,2, \tag{3}$$

b) finite state changes of the extrusion speed and the section bar exit temperature are employed c) to reduce computation effort and to damp the control system, the run of the extrusion speed is not changed at any time instant but is piece-wise linear, for instance constant, in a time interval j of duration m·Ta, whereby j=0,1,2, . . . , n−1,n and m is a natural number so that for every cycle i=0,1,2, . . . , n·m−1 d) The extrusion velocity run in eqn. (4) can be represented by elementary functions $$v_k(i\,T_A) = \sum_{j=0}^{n-1} \Delta v_{k_j}\, \sigma((i-j\,m)\,T_A) \tag{4}$$

whereby $\sigma(i\ T_A)$ is the Heaviside step function $$\sigma(i\ T_A)=\begin{cases}1 & i \geqq 0\\ 0 & sonst\end{cases} \tag{5}$$

and $$\Delta v_{k_j}=v_k(j\ m\ T_A)-v_k((j\ m-1)\ T_A)) \quad j=0,1,2,\ldots,n-1 \tag{6}$$

are the step heights in the extrusion speed run for the instants $j\cdot m\cdot T_A$.

e) Under the assumptions of linearity and time invariance, —assumptions which are justified in the neighbourhood of an operating trajectory—one has for the section bar exit temperature $$\theta a_k(i\ T_A)=\sum_{j=0}^{n-1}\Delta v_{k_j}\ h_k((i-j\ m)\ T_A) \tag{7}$$

whereby $h(i\ T_A)$ is the reaction of the extruder for a step input $\sigma(i\ T_A)$;

f) by inversion of eqn. (7) the step response $h(i\ T_A)$ is identified from measured runs of $va_k(i\ T_A)$ and $v_k(i\ T_A)$ $$h_k(i\ T_A)=\frac{1}{\Delta v_{k_0}}\left[\theta a(i\ T_A)-\sum_{j=0}^{l}\Delta v_{k_j}\ h_k((i-j\ m)\ T_A)\right], \quad lm \leqq i<(l+1)m. \tag{8}$$

Due to causality $$h_k(iT_A)=0,\ \text{for}\ i<0 \tag{9}$$

holds.

g) The run of the extrusion speed curve $v_{k+1}(i\ T_A)$ is obtained from the recursive control law (10):

$$v_{k+1}(iT_A)=v_k(iT_A)+dv_{k+1}(iT_A) \tag{10}$$

and $$va_{k+1}(iT_A)=va_k(iT_A)+dva_{k+1}(iT_A) \tag{11}$$

h) by miniraising a performance index Q $$\underset{\Delta dv_{k+1_j}}{Min}\left\{Q=\lambda\sum_{j=0}^{n-1}\Delta dv_{k+1_j}^2+\sum_{i=0}^{nm-1}[e_k(i\ T_A)-d\theta a_{k+1}(i\ T_A)]^2\right\} \tag{12}$$

in which $\lambda$ denotes a parameter which can be chosen suitably, w.r.t the control input increments $\Delta dv_{k+1j}$, the optimal run of the extrusion speed is obtained whereby $$e_k(iT_A)=va_w(iT_A)-va_k(iT_A) \tag{13}$$

denotes the measured control error in the immediately preceding cycle k and $$d\theta a_{k+1}(i\ T_A)=\sum_{j=0}^{n}\Delta dv_{k+1_j}\ h_k((i-j\ m)\ T_A) \tag{14}$$

denotes the change of the temperature run $dva_{k+1}(i\ T_A)$ effected by $\Delta dv_{k+1j}$ calculated in advance;

i) limiting of the control action $$\sum_{r=0}^{j}\Delta v_{k_r}\leqq v_{max_j} \quad j=0,1,2,\ldots,n-1 \tag{15}$$

$$\sum_{r=0}^{j}\Delta v_{k_r}\geqq v_{min_j} \quad j=0,1,2,\ldots,n-1 \tag{16}$$

is taken into account.

A schematic representation of the run of the extrusion speed of a cycle k is given in FIG. 3. The counter i represents thereby the index of the discrete time interval $T_A$. and j the index for the control input v(t) which is in every case constant at least or the interval m $T_A$; the change of input is denoted by $\Delta v_j$.

Under the assumption of time-invariance of the system which reacts with a function y(t) to an input x(t) the equation $$y^*(t)=y(t+\tau)\ \text{for}\ x^*(t)=x(t+\tau)$$

is valid. The time-invariance of the system considered here is given because of the constant parameters. Thus under assumptions of linearity and time-invariance in the neighbourhood of an operating trajectory $v_k(t)$ and $v_k(t)$, i.e. in the neighbourhood of $$v_{k+1}(t)=v_k(t)+dv_{k+1}(t) \tag{17}$$

$$v_{k+1}9t)=v_k(t)+dv_{k+1}(t) \tag{18}$$

eqn. (7) holds for exit temperature of the extruded bar. This is valid, even though the system behaviour of the extruder is nonlinear; for small changes of the input $v_k(t)$ the system is approximated as linear and the model error is negligible. The system behaviour described in eqn. (7) is obtained by inversion of this equation i.e. by solving eqn. (7) for $h_k(i\ T_A)$ as the set of linear eqns.(8), with which the step response $h_k(i\ T_A)$ can be identified after measuring the runs of $va_k(i\ T_A)$ and $v_k(i\ T_A)$. The value 1 in eqn. (8) can also be replaced by (n·m−1), as the terms for j>1 are identically equal to 0. Because of the causality of the system, which means that the system reacts as per eqn. (9) to an input only after the input has occurred, the run of the extrusion speed curve and the exit temperature of the bar can be calculated from the recursive control law (10) and (11) respectively.

The quantity to be determined is thus the input run of $v_{k+1}(t)$ for the extrusion cycle k+1, whereby the run $v_k(t)$ of the previous cycle is known, and thus $dv_{k+1}(t)$ given by eqns. (4) and (10) can be represented by eqn. (19)

$$dv_{k+1}(i\ T_A)=\sum_{j=0}^{n-1}\Delta dv_{k+1_j}\ \sigma((i-j\ m)\ T_A). \tag{19}$$

The changes of the input and control variables are thus described by the performance index Q according to eqn. (12) which is to be miniraised in the invented process.

Typical values of the parameters of the invented process lie in the range of 60 to 1000 s for $T_{cyc}$, 0.5 to 3 s for $T_A$, 10 to 20 for m and 10 to 15 for n. The value of the weighting factor $\lambda$ lies typically by about 0.05·m·h((n m−1) $T_A$) whereby h((n m−1) $T_A$) represents the steady state final value of the system step response.

If the input is not limited, the minimisation of the performance index Q in eqn. (12) can be performed with gradient, conjugate gradient, quasi-Newton, Newton Raphson or Newton methods.

If on the contrary the input i.e. the extrusion speed is limited, the minimisation is performed using the Kuhn-Tucker Method.

The performance index in eqn. (12) can also be replaced by an absolute value performance index (20), i.e.

$$Q=\lambda\sum_{j=0}^{n-1}\Delta dv_{k+1_j}^2+\sum_{i=0}^{nm-1}|e_k(i\ T_A)-d\theta a_{k+1}(i\ T_A)| \tag{20}$$

or one of the following performance indices:

$$Q=\sum_{j=0}^{n-1}\lambda_j\ \Delta dv_{k+1_j}^2+\sum_{i=0}^{nm-1}mu_i\ [e_k(i\ T_A)-d\theta a_{k+1}(i\ T_A)]^2 \tag{21}$$

-continued $$Q=\sum_{j=0}^{n-1}\lambda_j\,|\Delta dv_{k+1j}|+\sum_{i=0}^{nm-1}mu_i\,|e_k(i\,T_A)-d\theta a_{k+1}(i\,T_A)|. \tag{22}$$

Thereby $\lambda_j$ and $\mu_i$ are the weighting factors, which are chosen for each time interval. In eqn. (20) the weigthing factor $\lambda$ has typical range of $\lambda\approx 0.1\cdot m\cdot h\cdot(\,(n\ m-1)\ T_A)$. In eqn. (21) typical ranges are $$mu_i=\frac{i}{nm}\ \text{and}\ \lambda_j=0.05\cdot mu_{(j\cdot m)}\cdot h((nm-1)\cdot T_A)$$

and in eqn. (22) the ranges are:

$$mu_i=\frac{i}{nm}\ \text{and}\ \lambda_j=0.1\cdot mu_{(j\cdot m)}\cdot h((nm-1)\cdot T_A).$$

schematic representation of the run of the extrusion speed of a cycle k is given in FIG. 3.

The direct calculation of the step response in eqn. (8) can be replaced by least square algorithm, if the damping of the system is required due to the presence of disturbances. Then one has a) the impulse response of the plant $g_k(i\,T_A)$ introduced in eqn. (23):

$$\theta_k(i\,T_A)=\sum_{r=0}^{i}v_k(r\,T_A)\,g_k((i-r)\,T_A) \tag{23}$$

The impulse response is the reaction of the plant on an impulse defined in eqn. (24):

$$\delta(i\,T_A)=\begin{cases}1 & i=0\\ 0 & \text{otherwise}\end{cases} \tag{24}$$

b) thereby, for reducing the dimension of the problem only the first N values of the impulse are considered and the following condition is valid:

$$g_k(i\,T_A)=\begin{cases}\neq 0 & 0\leqq i\leqq N-1\\ 0 & \text{otherwise}\end{cases} \tag{25}$$

c) corresponding to the impulse response $g_k(i\ T_A)$ the performance index $$F=\sum_{i=0}^{nm-1}\left[\theta a_k(i\,T_A)-\sum_{r=0}^{i}v_k(r\,T_A)\,g_k((i-r)\,T_A)\right]^2+\sum_{s=0}^{N-1}[g_k(s\,T_A)-g_k((s-1)\,T_A)]^2 \tag{26}$$

has to be minimized, d) and the step response is the integral of the impulse response:

$$h_k(i\,T_A)=\sum_{r=0}^{i}g_k(r\,T_A) \tag{27}$$

The identification of the impulse response is formulated in eqn. (27). The impulse response $g_k(i\ T_A)$ is calculated such that the model error is a minimum and a smooth run of $g_k(i\ T_A)$ is obtained. The performance index F is relevant to identification only, it is not related to the performance index Q. The performance index Q is not influenced by F. The value of parameter N ranges between N=50 and 100, and its maximum value is N is n·m−1. The determination of the step response can also achieved by a least square algorithm in the frequency domain, thereby a) the plant operator in frequency domain is $$G_s(z)=\frac{\Theta(z)}{V(z)}=\frac{\sum_{r=1}^{N}b_r z^{(-r)}}{1+\sum_{s=0}^{N}a_s z^{(-s)}} \tag{28}$$

where $\Theta(z)$ and $V(z)$ present the Z-Transforms of the discrete time functions $v(i\ T_A)$ and $v(i\ T_A)$. The coefficients of the plant operator $a_s$ and $b_r$ are determined in a least square algorithm.

b) Applying the inverse Z-transformation on $G_s(z)$, the impulse response $$g_k(iT_A)=Z^{-1}[G_{s_k}(z)] \tag{29}$$

is obtained.

c) the step response is obtained with eqn. (27) again. The method minimizes the model error $$F=\sum_{i=0}^{nm-1}[\theta a_k(iT_A)-\theta m_k\,(iT_A)]^2 \tag{30}$$

thereby $\Theta O_{m,k}(i\ T_A)$ presents the value simulated by the model $$\theta m_k(iT_A)+\sum_{s=1}^{N}a_s\,\theta m_k((i-s)T_A)=\sum_{r=1}^{N}b_r v_k((i-r)T_A) \tag{31}$$

with the plant order N, which has a typical range between $1\leqq N\leqq 5$. In eqn. (28) the parameters $a_s$ and $b_r$ are the coefficients of the discrete plant operator. The Z-transforms $G(z)$, $\Theta(z)$ and $V(z)$ in eqn. (28) are defined by eqns. (32–34), where z denotes the complex frequency.

$$G_s(z)=\sum_{i=0}^{nm-1}g_k(iT_A)z^{-i} \tag{32}$$

$$\Theta(z)=\sum_{i=0}^{nm-1}\theta(iT_A)z^{-i} \tag{33}$$

$$V(z)=\sum_{i=0}^{nm-1}v(iT_A)z^{-i} \tag{34}$$

The inverse transformation is equivalent to the determination of the function in the time domain with the given Z-function as Z-transform. The measurement of the run of the exit temperature and the extrusion velocity and the evaluation in every cycle k and the subsequent calculation of extrusion velocity for the following cycle k+1 leads to a procedure in the invention, which is more robust due to disturbances of the contactless measurement of the exit temperature.

The invention facilitates temperature control in extrusion plants for extruding profiles with low or wavelength dependent emissivity ($\epsilon<1$) and/or time varying surface characteristics. The method is conceived for the temperature control in extrusion plants with high reflecting metallic profiles. The method is appropriate for the extrusion of aluminium and aluminium alloys.

The invented method allows the accurate control of an extrusion plant, maximises the productivity and guarantees high quality. The method can be applied everywhere, where the process temperature is critical.

We claim:

1. A process for controlling a cyclic extrusion process of an extrusion plant from cycle to cycle, comprising the steps of:

measuring for every cycle (k) an extrusion velocity input function $v_k(t)$ representing an extrusion velocity as a function of time and an exit temperature output function $va_k(t)$ representing an extrudate exit temperature as a function of time;

determining a plant operator which together with said measured extrudate exit temperature output function $va_k(t)$ and said extrusion velocity input function $v_k(t)$ define a plant equation for said cycle (k);

invoking said plant equation for said cycle (k) for estimating an extrudate exit temperature output function $va_{k+1}(t)$ of a cycle (k+1) for any chosen extrusion velocity input function $V_{k+1}(t)$ by inputting into said plant equation said extrusion velocity input function $v_{k+1}(t)$ for said cycle (k+1), wherein said extrusion velocity input function $v_{k+1}(t)$ for said cycle (k+1) can be chosen arbitrarily;

calculating via iteration an optimal value for said extrusion velocity input function $v_{k+1}(t)$ for said subsequent cycle (k+1) for substantially achieving a prescribed extrudate exit temperature output function $va_w(t)$ and suppressing abrupt changes of said optimal value for said extrusion velocity input function $v_{k+1}(t)$ by minimizing a prescribed performance index which takes into account not only an estimated control error but also the abruptness of changes in said optimal value for said extrusion velocity reference input function $v_{k+1}(t)$, said estimated control error defined by a deviation between said prescribed extrudate exit temperature output function $va_w(t)$ and said exit temperature output function $va_{k+1}(t)$ estimated and obtained in said step of invoking considering a prescribed boundedness of said extrusion velocity input function $v_{k+1}(t)$ of said cycle (k+1) while performing said step of calculating; and repeating the steps of measuring, determining, invoking, calculating and considering for each subsequent cycle.

2. The process according to claim 1, wherein:

said step of determining includes determining said linear plant operator which together with a differential extrusion velocity input function $dv_k(t)$ and a corresponding differential extrudate exit temperature $dva_k(t)$ defines the plant equation for differential extrusion velocity input function $dv_k(t)$ for said cycle (k), said differential extrusion velocity input function $dv_k(t)$ defined as the difference between extrusion velocity input function $v_k(t)$ used in said cycle (k) and the extrusion velocity input function used in a previous cycle, said differential extrudate exit temperature output function $dva_k(t)$ defined as the difference between extrudate exit temperature output function $va_k(t)$ measured in said cycle (k) and the extrudate exit temperature output function $va_k(t)$ measured in said previous cycle;

said step of invoking includes invoking said plant equation for differential extrusion velocity reference input functions for cycle (k) for estimating a differential extrudate output function $dva_{k+1}(t)$ of a subsequent cycle (k+1) for any chosen differential extrusion velocity input function $dv_{k+1}(t)$ for said cycle (k+1) by inputting into said plant equation said chosen differential extrusion velocity input function $dv_{k+1}(t)$ for cycle (k+1), wherein said chosen differential extrusion velocity input function $dv_{k+1}(t)$ for cycle (k+1) can be chosen arbitrarily;

said step of calculating via iteration includes calculating via iteration an optimal value for said differential extrusion velocity input function $dv_{k+1}(t)$ for use in said subsequent cycle (k+1) for substantially achieving said prescribed exit temperature $va_w(t)$ and suppressing abrupt changes of said extrusion velocity input function $v_{k+1}(t)$ for said subsequent cycle by minimizing a prescribed performance index which takes into account not only the estimated control error but also the abruptness of changes in said optimal value for said extrusion velocity input function $v_{k+1}(t)$, said estimated control error defined by the deviation between said prescribed extrudate exit temperature output function $va_w(t)$ and the sum of the extrudate exit temperature output function $va_k(t)$ of said cycle (k) and the estimated differential extrudate exit temperature output function $dv_{k+1}(t)$ obtained by said step of invoking using said differential extrusion reference input function $dv_{k+1}(t)$, whereby said extrusion velocity input function $v_{k+1}(t)$ for said cycle (k+1) is obtained by adding the input function used in said cycle (k) and said differential input function $dv_{k+1}(t)$.

3. The process according to claim 1, further comprising the step of representing said extrusion velocity input function $v_{k+1}(t)$ for said cycle (k+1) as the sum of said extrusion velocity input function $v_k(t)$ of said preceding cycle (k) and a differential velocity input function $dv_k(t)$ and representing said extrudate exit temperature output function $va_{k+1}(t)$ for said cycle (k+1) as the sum of said extrudate exit temperature output function $va_k(t)$ of said preceding cycle (k) and a differential extrudate exit temperature output function $dva_k(t)$.

4. The process according to claim 1, further including the steps of:

sampling said extrusion velocity reference input function $v_k(t)$ and said exit temperature function $va_k(t)$ at intervals of length T by considering instants of time $t=-iT_A$, with i=0,1,2, . . . ;

reducing computations via choosing said extrusion velocity function $v_k(t)$ to be segments of constant extrusion velocity of value $v_{kj}$ where j=0, 1, 2, . . . , n−1, each of duration $m \cdot T_A$, where n and m are natural numbers, the segmented extrusion velocity at the sampling instants being represented by $$v_k(iT_A) = \sum_{j=0}^{n-1} \Delta v_{k_j} \sigma((i-jm)T_A)$$

where $\sigma(i \cdot T_A)$ denotes a unit Heaviside function, $$\sigma(iT_A) = \begin{cases} 1 & i \geqq 0 \\ 0 & \text{else} \end{cases}$$

and $$\Delta v_{k_j} = v_k(jmT_A) - v_k(jm - 1T_A), \text{ with } j = 0, 1, 2, \ldots, n-1$$

denotes an increment of the extrusion velocity at the instant $j \cdot m \cdot T_A$;

representing the plant equation under conditions of linearity and time invariance via the equation $$\theta a_k(iT_A) = \sum_{j=0}^{n-1} \Delta v_{k_j} h_k((i-jm)T_A)$$

where $h(iT_A)$ is a step response of the extruder for a step input $\sigma(i \cdot T_A)$;

said step of determining further including calculating said step response $h(iT_A)$ by one of:

(1) inverting said exit temperature equation from the step of calculating exit temperature function $va_k(t)$ and calculating said step response $h(i\ T_A)$ identified from the measured functions $va_k(i\ T_A)$ and $v_k(i\ T_A)$ in said step of measuring via the equation $$h_k(iT_A)=\frac{1}{\Delta v_{k_0}}\left[\theta a(iT_A)-\sum_{j=0}^{l}\Delta v_{k_j}h_k((i-jm)T_A)\right],$$

$$lm \leqq i < (l+1)m.$$

whereby due to causality $$h_k(iT_A)=0, \text{ for } i<0$$

holds;

(2) if the system is subjected to large disturbances, calculating via a least square method from the integral of an impulse response $g_k(i\ T_A)$ of said plant which is introduced in the following equation, $$\theta_k(iT_A)=\sum_{r=0}^{i} v_k(rT_A)g_k((i-r)T_A)$$

wherein said impulse response is the reaction of the plant to an impulse defined in the following equation $$\delta(iT_A)=\begin{cases}1 & i=0\\ 0 & \text{otherwise}\end{cases}$$

where for the condition, $$g_k(iT_A)=\begin{cases}\neq 0 & 0 \leqq i \leqq N-1\\ 0 & \text{otherwise}\end{cases}$$

only the first N values of the impulse are considered, and wherein a performance index F corresponding to said impulse response $g_k(i\ T_A)$ to be minimized is represented by $$F=\sum_{i=0}^{nm-1}\left[\theta a_k(iT_A)-\sum_{r=0}^{i} v_k(rT_A)g_k((i-r)T_A)\right]^2+\sum_{s=0}^{N-1}[g_k(sT_A)-g_k((s-1)T_A)]^2$$

wherein said step response is the integral of said impulse response, and is represented by the equation $$h_k(iT_A)=\sum_{r=0}^{i} g_k(rT_A); \text{ and}$$

(3) in the frequency domain, calculating using a least square algorithm wherein said plant operator in said frequency domain is represented by the equation $$G_s(z)=\frac{\Theta(z)}{V(z)}=\frac{\sum_{r=1}^{N} b_r z^{(-r)}}{1+\sum_{s=0}^{N} a_s z^{(-s)}}$$

where $\Theta(z)$ and $V(z)$ represent the Z-Transforms of discrete time functions $v(i\ T_A)$ and $v(i\ T_A)$ and the coefficients of the plant operator $a_s$ and $b_r$ are determined in said least square algorithm, and wherein as the inverse Z-transformation is applied on $G_s(z)$, the impulse response is represented by the equation $$g_k(iT_A)=Z^{-1}[G_{s_k}(z)]$$

said step response equals the integral of the impulse response, as represented by the equation, $$h_k(iT_A)=\sum_{r=0}^{i} g_k(rT_A);$$

determining the extrusion speed reference function $V_{k+1}(i\ T_A)$ for the subsequent cycle (k+1) using the equations $$v_{k+1}(iT_A)=v_k(iT_A)+dv_{k+1}(iT_A)$$

$$\theta a_{k+1}(iT_A)=\theta a_k(iT_A)+d\theta a_{k+1}(iT_A)$$

and $$d\theta a_{k+1}(iT_A)=\sum_{j=0}^{n}\Delta dv_{k+1_j}h_k((i-jm)T_A)$$

finding by iteration the set of values of $\Delta v_{k+1_j}$ for j=0,1,2, . . . , n−1 which minimize a performance index represented by one of $$Q=\lambda\sum_{j=0}^{n-1}\Delta dv_{k+1_j}^2+\sum_{i=0}^{nm-1}|e_k(iT_A)-d\theta a_{k+1}(iT_A)|$$

$$Q=\lambda\sum_{j=0}^{n-1}\Delta dv_{k+1_j}^2+\sum_{i=0}^{nm-1}|e_k(iT_A)-d\theta a_{k+1}(iT_A)|$$

$$Q=\sum_{j=0}^{n-1}\lambda_j\Delta dv_{k+1_j}^2+\sum_{i=0}^{nm-1}mu_i[e_k(iT_A)-d\theta a_{k+1}(iT_A)]^2$$

$$q=\sum_{j=0}^{n-1}\lambda_j|\Delta dv_{k+1_j}|+\sum_{j=0}^{nm-1}mu_i|e_k(iT_A)-d\theta a_{k+1}(iT_A)|.$$

in which λ denotes a parameter which can be chosen suitably and is a minimum and λj and μ are weighing factors which are chosen for each time interval, whereby $$e_k(iT_A)=\theta a_w(iT_A)-\theta a_k(iT_A)$$

and $$dv_{k+1}(iT_A)=\sum_{j=0}^{n-1}\Delta dv_{k+1_j}\sigma((i-jm)T_A).$$

hold.

5. The process according to claim 4, further comprising the step of limiting said extrusion velocity function $v_k(t)$ in a manner represented by the formulas $$\sum_{r=0}^{j}\Delta v_{k_r}\leqq v_{max_j}\quad j=0,1,2,\ldots,n-1$$

$$\sum_{r=0}^{j}\Delta v_{k_r}\geqq v_{min_j}\quad j=0,1,2,\ldots,n-1$$

wherein minimization of the performance index Q is performed using Kuhn-Tucker method.

6. The process according to claim 4, wherein the control action is not limited and minimization of the performance index Q is performed with one of gradient, conjugate gradient, quasi-Newton, Newton Raphson or Newton methods.

7. The process according to claim 1, wherein said material is extruded sections of metals.

8. The process according to claim 7, wherein said metals have at least one of low emissivity, wavelength dependent emissivity and variable emissivity due to surface characteristics.

9. The process according to claim 8, wherein said metals are one of aluminum and aluminum alloys.

10. A process for maintaining an actual exit temperature of an extruder equal to a prescribed exit temperature for said extruder, comprising the steps of:

measuring extrusion velocity and actual exit temperature over a complete cycle (k);

determining a plant equation defining a relationship between said actual exit temperature and said extrusion velocity using measurements from said step of measuring over said cycle (k);

calculating via iteration and employing said plant equation an extrusion velocity reference input for the entirety of the subsequent cycle (k+1) prior to beginning said cycle (k+1) such that a prescribed performance index which takes into account a control error and the fluctuations of the extrusion velocity reference input is minimized;

inputting said subsequent extrusion velocity reference input into said plant equation for use in executing said subsequent cycle (k+1); and repeating said steps of measuring, determining, calculating, and inputting for further subsequent cycles, whereby said actual exit temperature for said subsequent cycle (k+1) is maintained substantially equal to said prescribed exit temperature and control error is maintained as low as possible.

11. The process according to claim 10, comprising said step of measuring including estimating said extrusion velocity and actual exit temperature by segregating said extrusion velocity and actual exit temperature as a function of time into intervals and measuring finite changes in said extrusion velocity for each of said intervals.

12. The process according to claim 11, wherein the step of determining a plant equation includes determining a step response of said extruder.

* * * * *